US006168173B1

(12) United States Patent
Reuss et al.

(10) Patent No.: US 6,168,173 B1
(45) Date of Patent: Jan. 2, 2001

(54) SNOWBOARD BOOT WITH BINDING INTERFACE

(75) Inventors: Stefan Reuss, Burlington; David J. Dodge, Williston, both of VT (US)

(73) Assignee: The Burton Corporation, Burlington, VT (US)

( * ) Notice: Under 35 U.S.C. 154(b), the term of this patent shall be extended for 0 days.

(21) Appl. No.: 08/974,025

(22) Filed: Nov. 19, 1997

(51) Int. Cl.[7] ..... B62B 9/04; A63C 9/00; A63C 9/10

(52) U.S. Cl. ..... 280/14.2; 280/613; 280/627

(58) Field of Search ..... 280/14.2, 613, 280/607, 617, 618, 623, 627; 36/117.1

(56) References Cited

U.S. PATENT DOCUMENTS

| | | | | |
|---|---|---|---|---|
| D. 382,320 | * | 8/1997 | Sand | D21/230 |
| 3,775,875 | | 12/1973 | Dvorsky | 36/72 A |
| 3,852,896 | * | 12/1974 | Pyzel et al. | 280/613 |
| 3,945,658 | | 3/1976 | Frechin | 280/11.35 K |
| 4,021,056 | * | 5/1977 | Oakes | 280/613 |
| 4,060,256 | * | 11/1977 | Collombin et al. | 280/613 |
| 4,185,851 | * | 1/1980 | Salomon | 280/613 |

(List continued on next page.)

FOREIGN PATENT DOCUMENTS

| | | | |
|---|---|---|---|
| 39 16453 C2 | 8/1990 | (DE) | A63C 9/00 |
| 0 740 908 A1 | 11/1996 | (EP) | A43C 5/04 |
| 0 753 267 A1 | 1/1997 | (EP) | A43B 5/04 |

(List continued on next page.)

OTHER PUBLICATIONS

English Translation of French Publication 2 719 197.
Partial English Translation of Japanese Patent Laying–Open No. 7–303728.
English Translation of European Publication EP 0 740 908 A1.
English Translation of European Publication EP 0 753 267 A1.
English Translation of European Publication EP 0 753 269 A1.

*Primary Examiner*—Lanna Mai
*Assistant Examiner*—Jeffrey Restifo
(74) *Attorney, Agent, or Firm*—Wolfe, Greenfield & Sacks, P.C.

(57) ABSTRACT

An apparatus comprising a snowboard boot and a binding interface including an interface feature that is adapted to releasably engage with a snowboard binding. The binding interface is movably mounted to the boot so that the boot can flex in a side-to-side direction through an angle relative to the binding interface to provide side-to-side flexibility. In one embodiment, the binding interface is mounted to the boot at a pair of laterally spaced attachment points with a pair of strapless fasteners. In another embodiment, the binding interface is mounted to at least one attachment point and a portion of the boot is flexible between the attachment point and a side. In other embodiments, at least a portion of the interface feature does not protrude below the bottom surface of the boot, and the interface feature does not protrude beyond the sides of the boot. In yet other embodiments, the apparatus includes an adjustment member to adjustably restrict the side-to-side flexibility between the boot and the binding interface, and a dampening element that dampens the side-to-side flexibility. The boot may include an arcuate lower surface that extends across the boot with the binding interface mounted to the boot below the arcuate lower surface. A fluid-filled bladder may be provided to control the side-to-side flexibility of the boot. The binding interface may be slidably mounted to the boot using arcuate surfaces, such as convex and concave surfaces, that allow the boot to slide across the binding interface.

79 Claims, 8 Drawing Sheets

U.S. PATENT DOCUMENTS

| | | | | |
|---|---|---|---|---|
| 4,316,618 | * | 2/1982 | Sampson | 280/611 |
| 4,601,118 | | 7/1986 | Zanatta | 36/120 |
| 4,652,007 | | 3/1987 | Dennis | 280/618 |
| 4,741,550 | | 5/1988 | Dennis | 280/618 |
| 4,848,781 | | 7/1989 | Dykema et al. | 280/14.2 |
| 4,973,073 | | 11/1990 | Raines et al. | 280/624 |
| 4,995,632 | | 2/1991 | Girault et al. | 280/615 |
| 5,028,068 | | 7/1991 | Donovan | 280/618 |
| 5,035,443 | | 7/1991 | Kincheloe | 280/618 |
| 5,054,807 | | 10/1991 | Fauvet | 280/607 |
| 5,069,463 | | 12/1991 | Baud et al. | 280/14.2 |
| 5,172,924 | | 12/1992 | Barci | 280/14.2 |
| 5,299,823 | | 4/1994 | Glaser | 280/625 |
| 5,401,041 | | 3/1995 | Jespersen | 280/14.2 |
| 5,474,322 | | 12/1995 | Perkins et al. | 280/613 |
| 5,505,477 | | 4/1996 | Turner et al. | 280/613 |
| 5,520,406 | | 5/1996 | Anderson et al. | 280/624 |
| 5,558,355 | | 9/1996 | Henry | 280/624 |
| 5,577,756 | | 11/1996 | Caron | 280/617 |
| 5,577,757 | | 11/1996 | Riepl et al. | 280/624 |
| 5,595,396 | | 1/1997 | Bourdeau | 280/607 |
| 5,669,630 | * | 9/1997 | Perkins et al. | 280/613 |
| 5,690,350 | * | 11/1997 | Turner et al. | 280/613 |
| 5,697,631 | * | 12/1997 | Ratzek et al. | 280/613 |
| 5,722,680 | * | 3/1998 | Dodge | 280/624 |
| 5,803,467 | * | 9/1998 | Piotrowski | 280/618 |
| 5,887,886 | * | 3/1999 | Bourdeau | 280/613 |
| 5,906,388 | * | 5/1999 | Neiley | 280/613 |
| 5,954,358 | * | 9/1999 | Bejean et al. | 280/627 |
| 5,992,861 | * | 11/1999 | Piotrowski | 280/618 |
| 6,022,040 | * | 2/2000 | Buzbee | 280/618 |
| 6,079,731 | * | 6/2000 | Emig et al. | 280/607 |

FOREIGN PATENT DOCUMENTS

| | | | |
|---|---|---|---|
| 0 753 269 A1 | 1/1997 | (EP) | A43B 5/04 |
| 2 628 000 | 9/1989 | (FR) | A63C 15/05 |
| 2 656 227 | 6/1991 | (FR) | A63C 9/18 |
| 2 673 546 | 9/1992 | (FR) | A63C 9/18 |
| 2 719 197 A1 | 11/1995 | (FR) | A43B 5/04 |
| 7-303728 | 11/1995 | (JP) | A63C 9/086 |
| WO 92/09339 | 6/1992 | (WO) | A63C 9/08 |
| WO 96/14123 | 5/1996 | (WO) . | |
| WO 96/26774 | 9/1996 | (WO) | A63C 9/08 |
| WO 96/36407 | 11/1996 | (WO) | A63C 9/08 |
| WO 97/03734 | 2/1997 | (WO) . | |
| WO 97/17860 | 5/1997 | (WO) | A43B 5/04 |

* cited by examiner

SNOWBOARD BOOT WITH BINDING INTERFACE

BACKGROUND OF THE INVENTION

1. Field of the Invention

The present invention relates to a snowboard boot having a binding interface that facilitates side-to-side movement of the snowboard boot relative to a snowboard.

2. Description of Related Art

Snowboard riders typically prefer some degree of side-to-side flexibility between their snowboard boots and snowboard. Side-to-side flexibility (also known as foot roll) enhances the rider's ability to more easily shift his or her weight and body position over the board for balance and control. Side-to-side flexibility may also improve the overall ride by allowing bumps to be more readily absorbed than if the boot was rigidly attached to the board without any side-to-side flexibility. Thus, the ability of the boot to roll side-to-side relative to the board provides a performance and feel that many riders find desirable.

A rider's boots are secured to the board via bindings that are typically disposed at an angle relative to the longitudinal axis of the board. Since the angle is a matter of personal preference, conventional snowboard bindings enable the rider to adjust and fix the rotational orientation of each binding to suit the rider's individual style. Generally, the degree of side-to-side flexibility preferred by a rider is a function of the boot orientation relative to the board. For example, when the boots 20 are positioned perpendicular to the longitudinal axis Y—Y of the snowboard 21 as illustrated in FIG. 1*a*, a rider may prefer a greater amount of side-to-side flexibility than when the boots are positioned at less of an angle to the longitudinal axis of the board, as illustrated in FIG. 1*b*. The boots 20 may have different angular orientations relative to each other, and the rider may wish to have a different degree of side-to-side flexibility for each boot.

Snowboard boots are of three general types, i.e., hard boots, soft boots and hybrid boots which combine various attributes of both hard and soft boots. A hard boot is similar to an alpine ski boot and typically employs a relatively hard molded plastic shell for supporting a rider's foot and lower leg with minimal foot movement allowed by the boot. Hard boots are generally preferred by riders that engage in racing or alpine riding which requires fluid edge-to-edge movement for smooth carving in the snow at high speeds. Hard boots conventionally have been secured to the board using plate bindings that include front and rear bails or clips that engage the toe and heel portions of the boot. The bails in these bindings inherently allow the boot to roll side-to-side relative to the snowboard, which is desirable for the reasons stated above.

Soft boots, as the name suggests, typically are comprised of softer materials that are more flexible than the plastic shell of a hard boot. Soft boots are generally more comfortable and easier to walk in than hard boots, and are generally favored by riders that engage in recreational, "freestyle" or trick-oriented snowboarding. Soft boots conventionally have been secured to the board using a strap binding which includes several straps that are tightened across various portions of the boot. The straps are typically formed of a plastic material that inherently has some flexibility that allows the sole of the boot to roll side-to-side within the binding.

More recently, side-grip snowboard bindings have been developed for use with soft snowboard boots. Examples of such side-grip binding systems are disclosed in U.S. Pat. No. 5,299,823 (Glaser) and U.S. Pat. No. 5,520,406 (Anderson). These bindings generally employ rigid, metal engagement members that firmly grip opposite sides of a metal binding interface that is attached to the boot sole. The metal-to-metal contact between the binding and the interface results in the sole of the boot being more rigidly attached to the board than with a plate or strap binding. Additionally, because these types of bindings do not directly engage the toe or heel of the boot, the sole of the boot must generally be relatively stiff to prevent the rider's toe or heel from undesirably lifting away from the board when riding. This stiffness is typically provided by an internal stiffener that extends the length and width of the sole. The combination of a stiff boot sole and a binding that rigidly grips the sides thereof essentially eliminates any side-to-side flex or roll between the boot and the binding. Thus, when the snowboard boots are secured to the binding, there is little, if any, side-to-side roll or flexibility between the boot sole and the board.

It should be understood that when the sole of the boot is rigidly attached to the board, the boot itself, particularly if a hard shell boot, provides little, if any, side-to-side flexibility. The side-to-side flexibility afforded by snowboard boots is generally a function of the stiffness of the boot shell, which impacts the ability of the rider to roll the foot or flex the ankle within the boot. However, since the ankle joint itself has limited side-to-side flexibility, even soft shell boots may not provide the rider with as much side-to-side flexibility as a rider may desire when used in conjunction with side-grip bindings that rigidly engage the boot sole. Rather, the feel that most riders desire is achieved only by enabling the sole of the boot to roll side-to-side relative to the board.

In view of the foregoing, it is an object of the present invention to provide an improved method and apparatus for interfacing a snowboard boot and a snowboard.

SUMMARY OF THE INVENTION

In one illustrative embodiment of the invention, an apparatus is provided that comprises a snowboard boot and a binding interface that includes at least one interface feature that is adapted to engage with a snowboard binding. The boot includes a pair of attachment points that are spaced apart in a side-to-side direction. The binding interface is movably mounted to the snowboard boot so that the snowboard boot can flex, relative to the binding interface, in the side-to-side direction through an angle to provide side-to-side flexibility. The binding interface is mounted to the boot at the pair of attachment points with a pair of strapless fasteners.

In another illustrative embodiment, an apparatus is provided that comprises a snowboard boot that includes a bottom surface, and a strapless binding interface that is movably mounted to the snowboard boot so that the snowboard boot can flex side-to-side relative to the binding interface to provide side-to-side flexibility. The binding interface includes a first interface feature disposed adjacent a first side of the boot and a second interface feature disposed adjacent a second side of the boot. The first and second interface features are adapted to engage with a snowboard binding. At least a portion of one of the first and second interface features does not protrude below the bottom surface of the boot.

In a further illustrative embodiment of the invention, an apparatus is provided that comprises a snowboard boot including a first side and a second side, and a strapless binding interface movably mounted to the snowboard boot so that the snowboard boot can flex side-to-side relative to the binding interface to provide side-to-side flexibility. The binding interface includes at least one interface feature that is adapted to engage with a snowboard binding, wherein the at least one interface feature does not protrude beyond the first and second sides of the boot.

In another illustrative embodiment of the invention, an apparatus is provided that comprises a snowboard boot, a binding interface movably mounted to the snowboard boot so that the snowboard boot can flex side-to-side relative to the binding interface to provide side-to-side flexibility, and an adjustment member supported by one of the boot and the binding interface. The adjustment member is constructed and arranged to adjustably restrict the side-to-side flexibility between the boot and the binding interface. The binding interface includes at least one interface feature that is adapted to engage with a snowboard binding.

In a further illustrative embodiment of the invention, an apparatus is provided that comprises a snowboard boot, a binding interface movably mounted to the snowboard boot so that the snowboard boot can flex side-to-side relative to the binding interface to provide side-to-side flexibility, and a dampening element coupled to at least one of the boot and the binding interface. The dampening element is constructed and arranged to dampen the side-to-side flexibility between the boot and the binding interface. The binding interface includes at least one interface feature that is adapted to engage with a snowboard binding.

In yet another illustrative embodiment of the invention, an apparatus is provided that comprises a snowboard boot including an arcuate lower surface that extends across the boot in a side-to-side direction, and a binding interface movably mounted to the snowboard boot below the arcuate lower surface, so that the snowboard boot can flex side-to-side relative to the binding interface to provide side-to-side flexibility. The binding interface includes at least one interface feature that is adapted to engage with a snowboard binding.

In yet a further illustrative embodiment of the invention, an apparatus is provided that comprises a snowboard boot including a sole and at least one attachment point, and a binding interface that is movably mounted to the snowboard boot at the at least one attachment point and that includes at least one interface feature adapted to engage with a snowboard binding. At least one portion of the sole disposed between the at least one attachment point and a side of the boot is flexible so that the snowboard boot can flex side-to-side relative to the binding interface.

BRIEF DESCRIPTION OF THE DRAWINGS

The foregoing and other objects and advantages of the present invention will become apparent with reference to the following detailed description when taken in conjunction with the accompanying drawings in which.

DETAILED DESCRIPTION OF ILLUSTRATIVE EMBODIMENTS

In accordance with one illustrative embodiment of the invention, a snowboard boot system is provided that includes a snowboard boot and a binding interface that is supported on the boot and is adapted to engage with a binding. The interface is supported from the boot so that even when the interface is rigidly engaged by the binding, the boot can advantageously roll or flex side-to-side relative to the snowboard. As discussed below, the binding interface can be movably supported on a bottom portion of the boot so that the boot may roll or lift about its longitudinal axis relative to the interface. The binding interface of the present invention can be used with any type of snowboard boot, including hard shell boots, soft shell boots and hybrid boots. In addition, the binding interface can be adapted to be compatible with any type of binding. Thus, it should be appreciated that the illustrative embodiments discussed below are provided merely for illustrative purposes, and that numerous other implementations are possible.

Figure 1A:
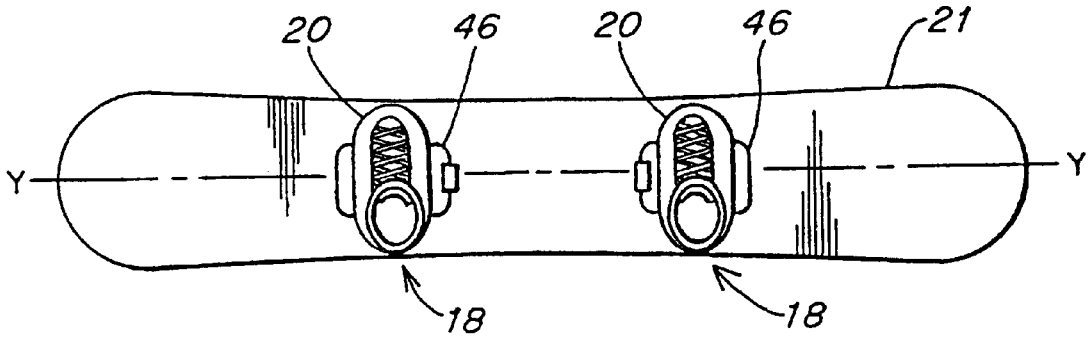
FIG. 1*a* is a top view of a pair of snowboard boots positioned approximately perpendicular to the longitudinal axis of a snowboard.
Figure 1B:
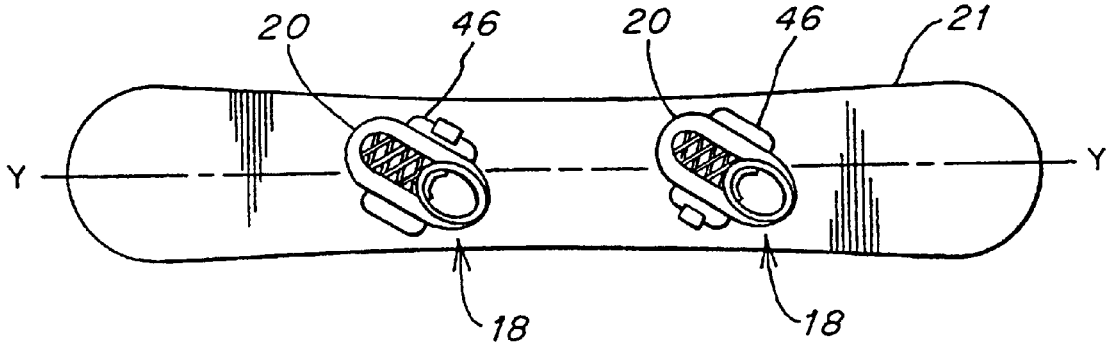
FIG. 1*b* is a top view of the pair of boots of FIG. la positioned at a smaller angle relative to the longitudinal axis of the board.
Figure 2:
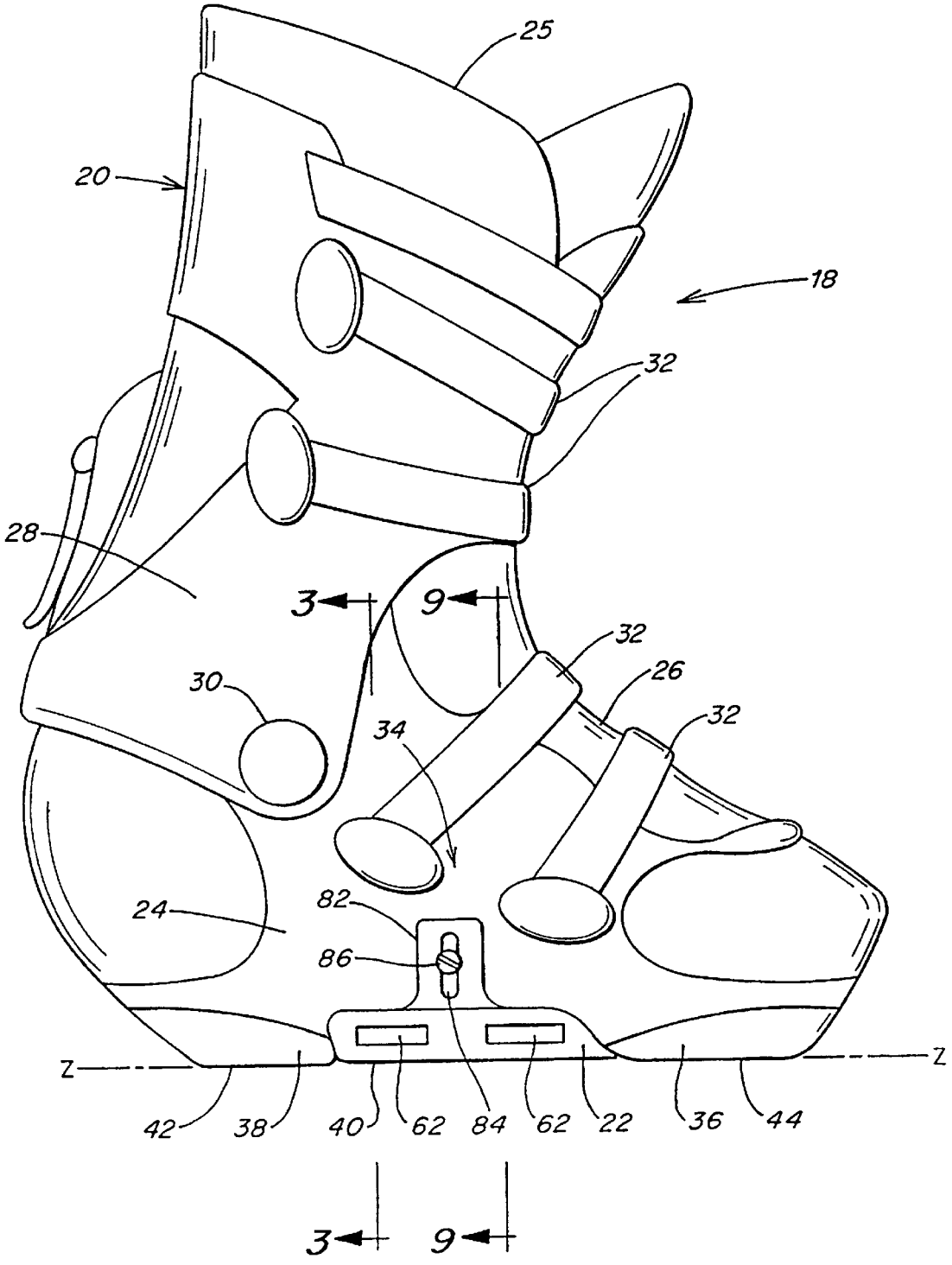
FIG. 2 is a side elevational view of a snowboard boot system according to one illustrative embodiment of the present invention.
Figure 3:
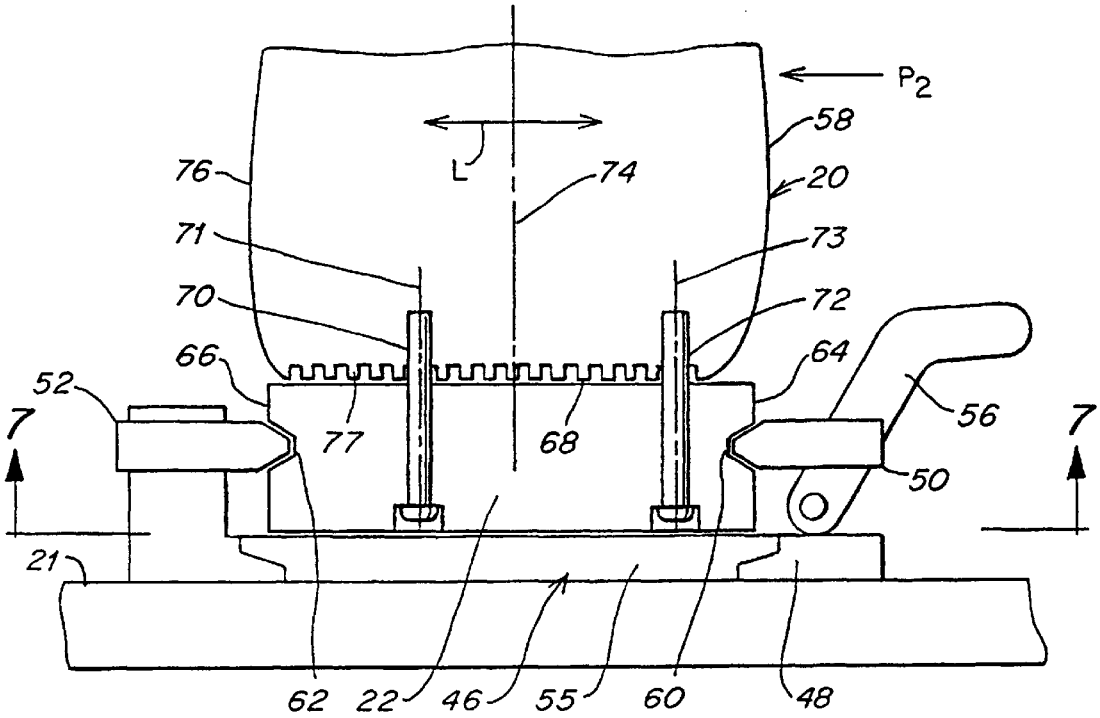
FIG. 3 is a schematic cross-sectional view along section line 3—3 of FIG. 2 illustrating the snowboard boot system of FIG. 2 secured to a snowboard binding.
Figure 4:
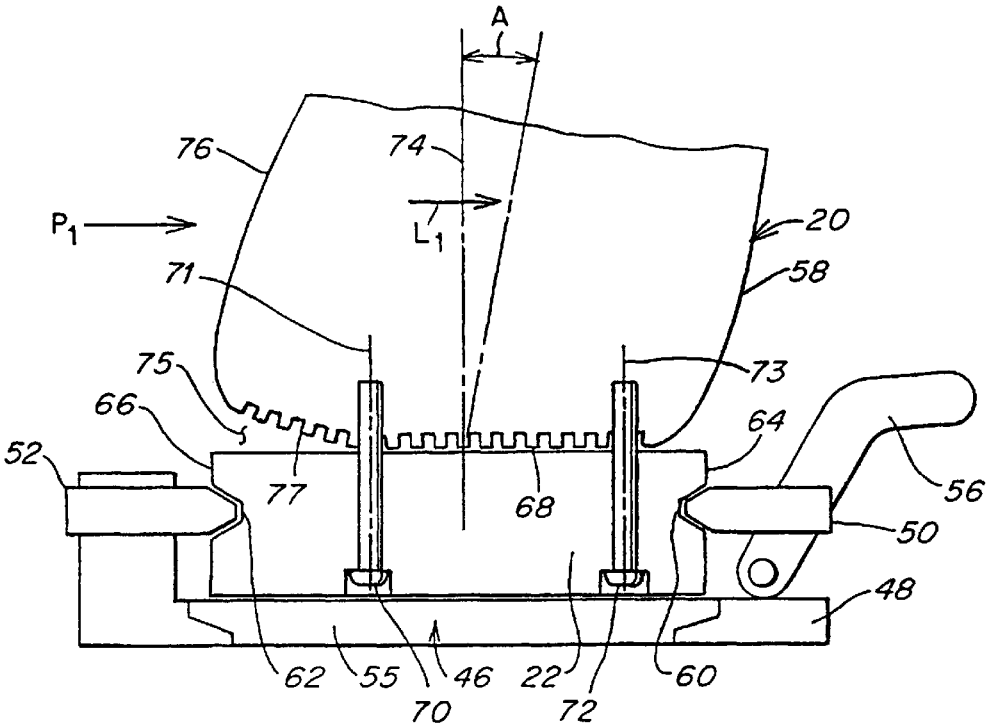
FIG. 4 is a schematic view of the snowboard boot of FIG. 3 flexed to one side relative to the binding interface.

In one illustrative embodiment of the invention shown in FIGS. 2–4, a snowboard boot system 18 is provided that includes a snowboard boot 20 and a binding interface 22 that is supported on the boot in a manner that, even when the interface is rigidly engaged by a binding, advantageously allows the boot to roll or flex side-to-side. As discussed below, the binding interface 22 is movably supported on a bottom portion of the boot and is adapted to engage the binding so that, when the interface is fixed to the binding, the boot may roll or lift about its longitudinal axis relative to the interface. The illustrative snowboard boot 20 shown in FIG. 2 is a hard boot of conventional construction, and includes a shell 24, a liner 25, a tongue 26 extending along the front portion of the boot, and a cuff 28 for supporting the lower portion of the rider's leg. The cuff 28 may be pivotally connected to the shell 24 using a fastener 30, such as a rivet or pin, to provide the rider with the ability to flex his leg in a forward direction. One or more straps 32 may be provided so that the rider can tighten the boot about his foot. As discussed above, the present invention is not limited to any particular boot configuration, and can be employed with boots of many other types.

In the illustrative embodiment shown in FIGS. 2–4, a strapless binding interface 22 is supported, without the use of straps, below the in-step portion 34 of the boot between a forward toe portion 36 and a rear heel portion 38. The binding interface 22 provides an interface for releasably attaching the boot to a side-grip binding. The bottom surface 40 of the binding interface 22 may be approximately coplanar with or disposed above a plane Z—Z defined by the bottom surfaces 42, 44 of the toe and heel platforms 36, 38, so that it does not interfere with the rider's ability to walk in the boots. The binding interface 22 may be formed from metal, glass-reinforced plastic or any of a number of other suitable materials.

As mentioned above, many different arrangements are possible for interfacing a snowboard boot to a binding, and the present invention is not limited to any particular arrangement. In the illustrative embodiments discussed below, the binding is a side-grip binding having engagement members that move laterally to engage the binding interface, and the binding interface has one or more recesses adapted to engage the binding engagement members. It should be appreciated that the present invention is not limited to a side-grip binding system, or to one wherein the interface has recesses for engaging the binding engagement members, as numerous alternate arrangements are possible that include different features for engaging the binding interface to the binding.

One illustrative example of a side-grip binding 46 is illustrated in FIGS. 3 and 4. The binding 46 includes a base plate 48, and one or more engagement members 50, 52 disposed on opposite sides of the base plate. The sides of the binding interface 22 include corresponding interface features 60, 62 that are adapted to engage with the engagement members 50, 52. The base plate 48 may be mounted to a snowboard 21 in a conventional manner using a hold-down disc 55 that enables adjustment of the orientation of the base plate. One or more of the engagement members 50, 52 may be coupled to an actuation member 56 so that the user may operate the binding to selectively lock and release the boot. The actuation member 56 may, for example, be a handle that is pivotally mounted to the base plate 48 adjacent the inner/medial side 58 of the boot. The engagement members 50, 52 may be elevated above the base plate 48 and extend inwardly to engage their corresponding interface features (recesses 60, 62 in the embodiment shown) provided in both the inner/medial side 64 and the outer/lateral side 66 of the binding interface 22. At least a portion of one of the interface features is disposed above the bottom surface of the boot. One or more recesses 60, 62 may be provided on each side of the binding interface.

An example of a binding interface for use with side-grip bindings is described in co-pending U.S. application Ser. No. 08/584,053, which is assigned to The Burton Corporation and is incorporated herein by reference. In one illustrative embodiment, the recesses 60, 62 are formed of a non-metallic material, such as an elastomeric material, to form a shock absorbing engagement between the boot and the binding. Non-metallic material also reduces the likelihood of snow being attracted to and clogging the recesses.

As shown in FIG. 2, the binding interface 22 may include multiple recesses 60, 62 on each side with a non-recessed portion disposed therebetween. In the embodiment shown in FIG. 2, a pair of recesses 62 is provided along at least one side of the binding interface. As discussed in application Ser. No. 08/584,053 referenced above, when formed from an elastomeric material, the use of multiple recesses provides a stronger engagement between the binding interface 22 and the binding 46 than a single recess. A pair of recesses doubles the number of recess mouth corners that resist forces tending to pry the recesses open. Additionally, a pair of recesses provides a greater bearing surface preventing front to back movement between the binding interface 22 and the binding 46. When multiple recesses are provided along one or both sides of the binding interface, they can be distributed about the center of the length of the boot (i.e., in the in-step area) in a manner that maximizes the stability of the engagement between the snowboard boot system 18 and the binding 46.

In the illustrative embodiment of the invention shown in FIGS. 3 and 4, the mouth of each recess 60, 62 is wider than its corresponding engagement member 50, 52, and the upper and lower walls are tapered inwardly toward each other to facilitate the engagement between the binding interface 22 and the binding 46. In particular, this recess configuration allows for easier alignment between the binding interface 22 and the engagement members 50, 52, even when snow or ice has accumulated between the boot 20 and the base plate 48. Additionally, when the engagement members 50, 52 are moved into engagement with the recesses 60, 62, the tapered walls direct accumulated snow and ice out of the recesses to securely lock the snowboard boot system 18 to the binding 46. The walls are angled a sufficient amount to facilitate alignment with the engagement members without reducing the effectiveness of the recesses to retain the engagement members therein. In one embodiment, the walls are angled within a range of approximately 95–135 degrees from a horizontal plane, with an angle of approximately 105 degrees having been found to work effectively.

Examples of snowboard side-grip bindings that are compatible with the illustrative binding interface shown in the figures are described in co-pending U.S. application Ser. Nos. 08/655,021; 08/674,976; and 08/780,721, each of which is assigned to The Burton Corporation and is incorporated herein by reference. The side-grip binding 46 and the recesses 60, 62 for engagement therewith have several advantages as described in the related applications. However, it should be understood that the present invention is not limited in this respect, and that the binding interface 22 can alternatively include other interface feature configurations (e.g., plates, rods or the like that extend toe-to-heel or side-to-side, and that extend either within the profile of the boot, underneath the boot or outwardly beyond the boot profile) that are adapted to engage with compatible engagement members on other types of bindings to secure the boot thereto.

In the embodiment of the invention illustrated in FIGS. 3 and 4, the binding interface 22 is mounted to the bottom 68 of the boot 20 using one or more pairs of strapless fasteners 70, 72 in a manner that allows the boot 20 to roll or pivot in a side-to-side direction L. The fasteners 70, 72 can include mechanical fasteners (e.g., screws, pins, rivets or the like), chemical fasteners (e.g., adhesive or the like) or a combination thereof to resist separation between the binding interface and the boot. The amount and direction of side-to-side flexibility can be controlled by controlling the positioning of the fasteners 70, 72 relative to the sides of the boot. When the fasteners 70, 72 are located close to the sides of the boot 20, there is substantially no relative movement between the binding interface 22 and the boot 20, because the interface is effectively clamped to the edges of the boot. When the fasteners 70, 72 are located at a pair of attachment points 71, 73 that are positioned away from the sides of the boot and closer to a center longitudinal plane 74 extending along the length of the boot, the sides of the boot are not clamped to the binding interface 22, and can be lifted from the interface 22 when sufficient side-to-side pressure is exerted on the boot by the rider.

For example, in the embodiment shown in FIGS. 3–4, the interface is mounted to the boot with the attachment point 71 being spaced from the outer edge of the boot, which is not clamped to the interface, so that the rider can exert an inward force $P^1$ that is sufficient to cause the outer edge of the boot to lift as shown at 75 in FIG. 4. This allows the sole of the boot 20 to roll in an inward side direction $L^1$ relative to the binding interface 22. Since the interface 22 is rigidly clamped to the board 21, the sole of the boot 20 effectively rolls in a side-to-side direction relative to the board. In the embodiment shown in FIGS. 3–4, the attachment point 73 is adjacent the inner edge of the boot to clamp the inner edge to the interface 22 so that the boot does not roll in an outward side direction relative to the interface. However, it should be understood that the interface can be mounted to the boot with the attachment point 73 spaced from the inner edge so that an outward force on the boot causes the inner edge of the boot to lift.

In the embodiment of the invention shown in the figures, the boot 20 is engaged along the sides below the in-step portion 34, which is disposed between the toe portion 36 and the heel portion 38 of the boot. In this embodiment, the boot 20 is provided with a sole that is sufficiently stiff along at least a rear portion of its length to resist lifting forces generated when riding, so that the rider's heel does not lift off the board. The sole may also be stiff along a forward portion of its length to resist lifting forces at the toe, which are generally less than those at the heel. Conventional hard boots include a sole that is sufficiently stiff to resist heel and toe lift. However, when used with soft boots, one embodiment of the invention employs a stiffener that is attached to the sole of the boot to provide the desired sole stiffness.

When the boot sole is stiff over its entire width, placement of the attachment points 71, 73 away from the sides of the boot alone may not be sufficient to provide the desired foot roll. Accordingly, various techniques may be employed to allow side-to-side flexibility while also resisting heel and/or toe lift. These techniques can include techniques for construction of the boot sole, construction of the interface 22, attachment of the interface 22 to the sole, or a combination of the foregoing.

In one illustrative embodiment shown in FIGS. 3 and 4, the boot includes longitudinally extending ribs 77 or pleats that stiffen the boot along its length to prevent heel lift, but flex between adjacent ribs to allow the boot 20 to roll side-to-side. In hard boots, the ribs 77 may be formed directly on the shell 24 during the molding process. In soft boots, the ribs 77 may be formed on a stiffener plate that is attached to or molded in the boot sole. The ribs 77 may be provided across the entire width of the boot between its sides 58, 76 as shown in the figures, or the ribs 77 may be confined to those portions of the boot where side-to-side flexibility is desired, such as between one or both of the sides 58, 76 and its closest attachment point 71, 73. The ribs 77 may extend along the entire length of the boot.

As mentioned above, other techniques can also be used to provide this combination of longitudinal stiffness in the boot sole and side-to-side flex of the boot relative to the binding interface. For example, the plastic shell for a hard boot or the sole stiffener in a soft boot may be selectively thinned along the side edges to provide side-to-side flexibility, while also retaining longitudinal stiffness. Alternatively, the sole may be formed from a combination of materials having different structural properties. For example, the sole or midsole of the boot may include a central core of glass-filled nylon for stiffness and portions of ethyl vinyl acetate (EVA) disposed long the side edges of the sole for side-to-side flexibility. The nylon and EVA may be formed as separate parts and then bonded together, or they may be co-injected into a common mold.

As illustrated in FIGS. 3 and 4, the binding interface 22 may be mounted to the boot 20 using an attachment point pattern that is asymmetrical relative to the sides of the boot and controls both the direction and amount of side-to-side flex. In one embodiment shown in FIG. 4, the attachment point pattern is arranged so that the boot can roll to the inner/medial side, but not the outer/lateral side, as preferred by many riders. The inner fastener 72 is placed close to the inner side 58 of the boot to effectively clamp the boot 20 to the binding interface 22, thereby preventing the boot from rolling or flexing outwardly when subjected to an outward force $P^2$. Conversely, the outer fastener 70 is placed a greater distance from the outer side 76 of the boot toward the center plane 74 so that the outer side of the boot may lift from the binding interface 22 when subjected to an inward force $P^1$, thereby allowing the boot to roll or flex inwardly through an angle A. The position of the outer fastener 70 relative to the outer side 76 of the boot establishes the amount of side-to-side flex or roll that the boot may experience. For example, the outer fastener 70 can be located a predetermined distance from the outer side so that the boot may be flexed or rolled to the inner side through a maximum angle A of approximately 25°.

Figure 7:
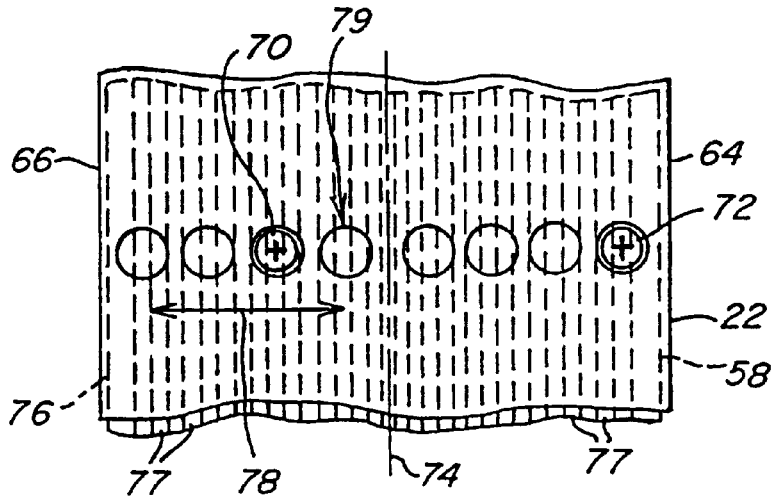
FIG. 7 is a schematic partial bottom view taken along view line 7—7 of FIG. 3 illustrating one embodiment for adjusting the amount of side-to-side flexibility of a snowboard boot.

Since the amount of side-to-side flexibility may be controlled by the distance of the fasteners 70, 72 relative to the sides of the boot, in one embodiment of the invention, the rider is provided with the ability to selectively position the fasteners 70, 72 to adjust the amount of side-to-side flexibility to his or her particular requirements. To this end, the boot 20 and the binding interface 22 may be constructed so that the position of the fasteners 70, 72 may be adjusted relative to the sides of the boot. In one illustrative embodiment shown in FIG. 7, the binding interface 22 and the boot 20 each is provided with an adjustable attachment feature 79, which may include a plurality of holes, a slot or a combination thereof, so that the position 78 of the fasteners 70, 72 relative to the sides of the boot can be adjustably selected by the rider. For example, the outer fastener 70 may be selectively positioned between the outer side 76 and the center plane 74 to adjust inward or medial flexibility of the boot. Similarly, the inner fastener 72 may be selectively positioned between the inner side 58 and the center plane 74 of the boot to adjust outward or lateral flexibility of the boot. In one embodiment, the binding interface has a maximum width of approximately 10 cm, and a width between the outer and inner fasteners 70, 72 of approximately 8 cm when each fastener is positioned at its corresponding side of the boot. The outer fastener 70 can be adjusted to a position within approximately 5 mm of the center plane 74 to maximize the inward roll or flexibility of the boot relative to the binding interface.

Figure 5:
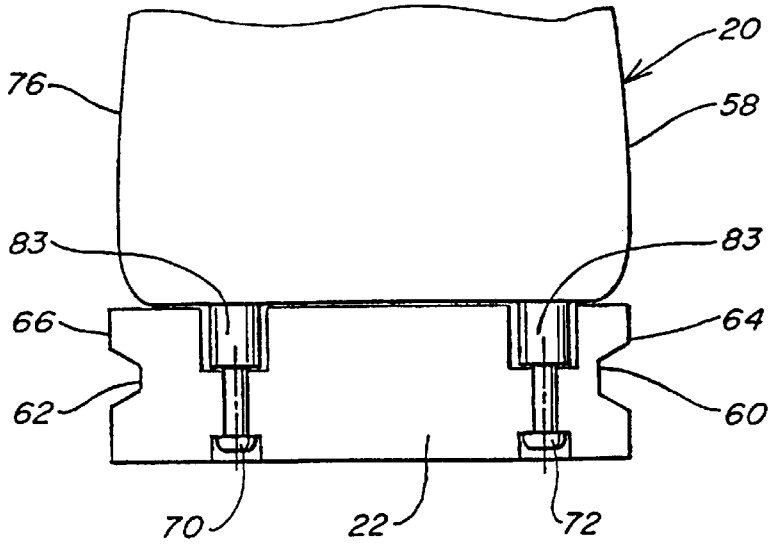
FIG. 5 is a schematic cross-sectional view taken along section line 3—3 of one embodiment of a flexible attachment mechanism for coupling a boot and a binding interface.
Figure 6:
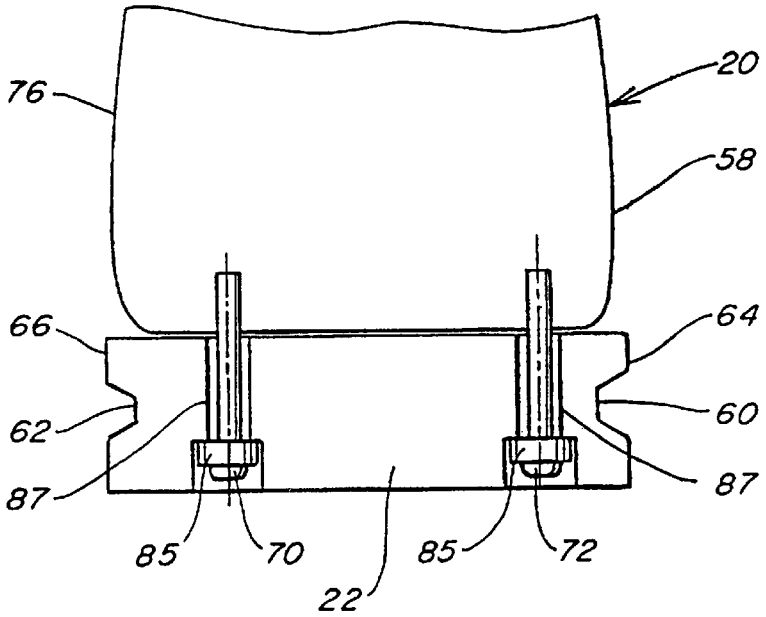
FIG. 6 is a schematic cross-sectional view taken along section line 3—3 of an alternate embodiment of a flexible attachment mechanism for coupling a boot and a binding interface.

In an alternate embodiment, the boot sole can have a stiffness at its sides that would not allow the sole to flex, and a flexible attachment mechanism coupling the boot 20 and the binding interface 22 can be employed to provide the desired side-to-side flexibility. For example, in one embodiment illustrated in FIG. 5, the boot 20 includes flexible interface attachment features, such as molded bosses 83 or other resilient elements, that are designed to allow the boot to flex relative to the binding interface. As illustrated, the binding interface 22 is mounted to the boot 20 using fasteners 70, 72 that are secured to the bosses 83. When sufficient force is applied to the boot 20, the bosses 83 flex (e.g., pivot or bend), thereby enabling the boot to move relative to the binding interface 22. In another embodiment illustrated in FIG. 6, a flexible attachment feature, such as a elastomeric washer 85 or other resilient element, is coupled between the binding interface 22 and one or more of the fasteners 70, 72 extending through boreholes 87 in the interface. For example, when the fastener 70, 72 is a screw as shown in FIG. 6, the washer 85 can be disposed between the head of the screw 70, 72 and the binding interface 22. When subjected to sufficient force, the washer 85 is compressed, thereby enabling the fastener 70, 72 to move within the boreholes 87 relative to the binding interface 22, which allows the boot 20 to flex side-to-side relative to the binding interface 22.

The flexible attachment mechanism may also be used to control the direction and amount of side-to-side flex. The spring characteristics of the flexible attachment features can be varied to control the amount of flex. Additionally, the flexible attachment features can have different spring characteristics to control the direction of flex. For example, the outer attachment features can be more flexible than the inner attachment features, thereby enabling the boot 20 to flex a greater amount in the inward or medial direction than the outward or lateral direction. In another embodiment, the location of the flexible attachment features can be selectively adjusted across the width of the boot and binding interface similar to the asymmetrical pattern technique discussed above to control the amount and direction of side-to-side flex.

Figure 8:
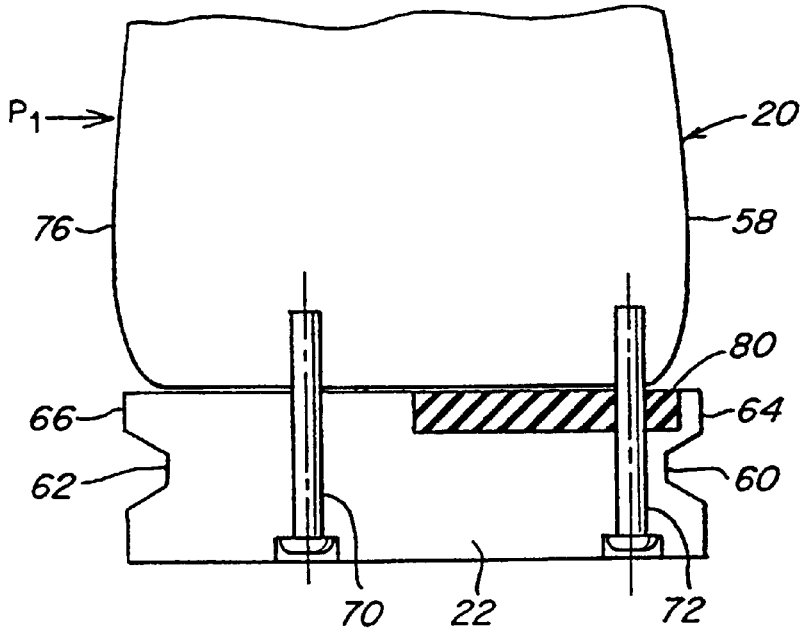
FIG. 8 is a schematic cross-sectional view taken along section line 3—3 of an alternate embodiment of the invention that includes a resilient element for enhancing the side-to-side flexibility of a snowboard boot.

In another illustrative embodiment shown in FIG. 8, the side-to-side flexibility provided by the binding interface 22 is enhanced by a resilient element 80 disposed between the boot 20 and the binding interface 22. In the embodiment shown in FIG. 8, the resilient element 80 is in the form of a pad placed along the inner portion of the binding interface 22 so that the inner side 58 of the boot 20 may move downwardly against the resilient element as a force $P^1$ is exerted inwardly to roll the boot. The resilient element 80 may be formed from rubber or other resilient material that can be compressed or otherwise deformed to allow the boot to roll relative to the binding interface. In one embodiment, it has a thickness from approximately 5 mm to approximately 1 cm, extends along the entire length of the binding interface 22 and has a width from approximately the center plane 74 of the boot to within approximately 3 mm of the inner edge 64 of the binding interface. It should be understood that these dimensions are exemplary and that other dimensions can be used. Alternatively, the resilient element 80 can be placed along the outer portion of the binding interface, instead of the inner portion, so that the outer side 76 of the boot 20 may move downwardly in response to an outward force on the boot. Additionally, a resilient element 80 can be placed along both the inner and outer portions of the binding interface, or a resilient element can be placed across the entire width of the binding interface. Further, one or more resilient elements 80 may alternatively be disposed on the bottom of the boot, rather than in the interface 22, to achieve similar results.

In another illustrative embodiment, an adjustment system is provided to limit or set the side-to-side flexibility of the boot 20 relative to the binding interface 22. In one illustrative embodiment shown in FIGS. 2 and 9, the adjustment system 81 includes an adjustment member 82 that extends upwardly from the outer edge 66 of the binding interface 22 and lies adjacent the outer side 76 of the boot shell 24. The adjustment member 82 has a vertical slot 84 through which a locking member 86, such as a screw, extends to engage a corresponding fastener, such as a threaded hole or nut, in the boot. When the locking member 86 is loosened, the boot 20 may freely flex within a predetermined range from 0° to a maximum angle A limited by the length of the slot. In addition to providing a stop that limits the maximum flex angle of the boot, the adjustment member 82 and the locking member 86 allow the rider to fix the angle A of the boot 20 relative to the binding interface 22. To fix the boot at a desired angle A, the rider can flex the boot to the desired angle, and then tighten the locking member 86 into the boot until the head of the screw is tightened against the adjustment member, thereby locking the boot at that angle. The specific angle A attained can be determined by providing an indicator, such as incrementally spaced indicia, along the adjustment member 82 or on the boot shell 24 adjacent the adjustment member.

Figure 9:
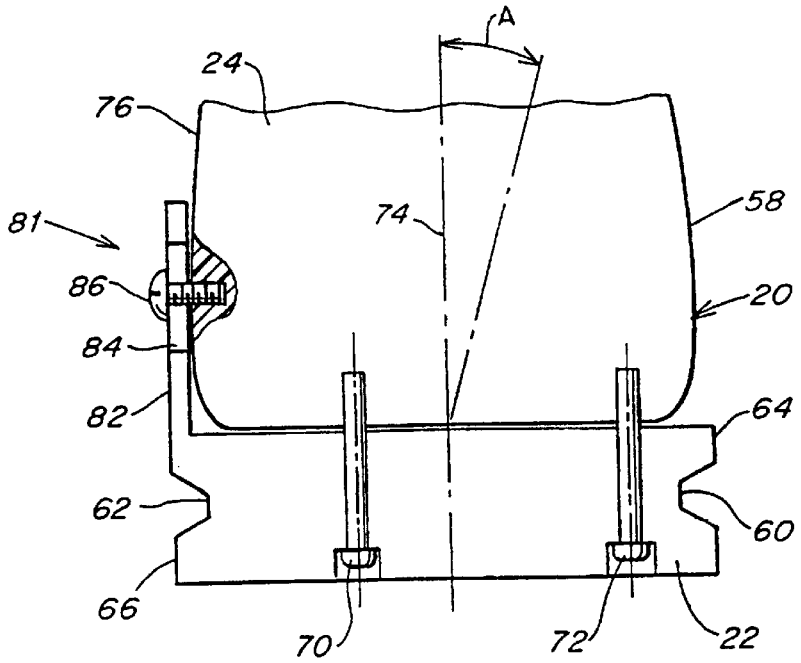
FIG. 9 is a schematic, partially fragmented, cross-sectional view taken along section line 9—9 of FIG. 2 of an embodiment for fixing a snowboard boot at a selected flex angle relative to the binding interface.

It should be understood that the particular implementation of the adjustment system 81 shown in FIGS. 2 and 9 is provided merely for illustrative purposes and that numerous other implementations of the system are possible. For example, the adjustment member 82 can be fixed to and extend downwardly from the boot 20 to lie adjacent the outer edge 66 of the binding interface 22 with the locking member 86 engaging a corresponding fastener in the binding interface. The adjustment system 81 can alternatively be provided along the inner side 58 of the boot, or an adjustment system 81 can be provided along both the outer side 76 and the inner side 58 of the boot to limit or set the flex in both directions.

Figure 10:
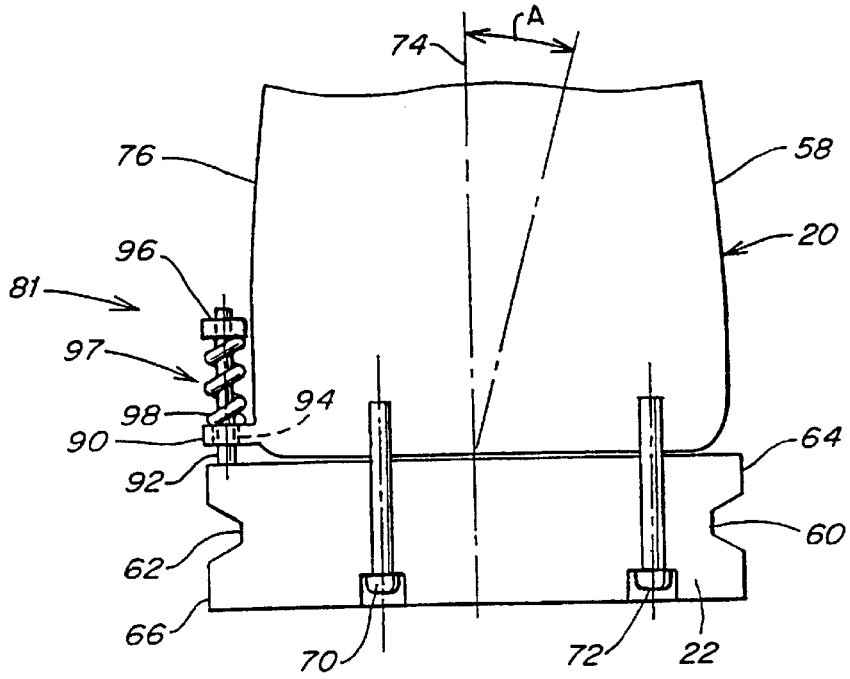
FIG. 10 is a schematic cross-sectional view similar to FIG. 9 of an alternate embodiment of the present invention including a mechanism for dampening the side-to-side flexibility of a snowboard boot.

Another illustrative embodiment of the adjustment system 81 is shown in FIG. 10. In this embodiment, a horizontal arm or extension 90 is disposed on the outer side 76 of the boot 20 above the binding interface 22. An adjustment member 92 extends vertically from the outer edge 66 of the binding interface 22 and through an aperture 94 in the arm 90. A retainer 96 is attached to the adjustment member 92 and is spaced from the arm 90 so that the boot 20 may flex within a range from 0° to a maximum angle A limited by the distance between the retainer 96 and the arm 90. It should be understood that the adjustment system 81 can alternatively be located on the inner side or on both sides of the boot. Furthermore, the adjustment member 92 may be disposed on the boot 20 to interact with an arm or similar structure on the binding interface.

In one embodiment of the invention, the retainer 96 is adjustably positioned along the adjustment member 92 so that the rider can selectively increase and decrease the range of side-to-side flex by increasing and decreasing the distance between the retainer 96 and the arm 90. The retainer 96 can be positioned along the adjustment member 92 against the arm 90 to completely lock down the boot so that it cannot be flexed relative to the binding interface. The retainer 96 may be a nut or other suitable fastener that adjustably interacts with the adjustment member 92, which can be in the form of a threaded shaft.

In one embodiment of the invention, the adjustment system 81 includes a dampening feature to produce a smooth flexing motion without an abrupt stop as the boot is flexed to the extreme limits of its range. One illustrative implementation of a dampening system 97 is shown in FIG. 10, wherein a dampening element 98, such as a compression spring or other resilient element, is secured about the adjustment member 92 between the arm 90 and the retainer 96. As the boot 20 flexes, the dampening element 98 is compressed between the arm 90 and the retainer 96, thereby producing a variable force that opposes the side-to-side flexing and increases in proportion to the amount of flex, resulting in a smooth flex, rather than an abrupt stop. In addition to selecting the range of flex of the boot 20, adjustment of the retainer 96 along the adjustment member 92 also increases or decreases the resistance to any side-to-side flex by adjusting the amount of force initially opposing the side-to-side flex. In addition, the rate of side-to-side flex may be adjusted by using dampening elements 98 having varied dampening characteristics, e.g., springs with different spring constants.

Figure 11:
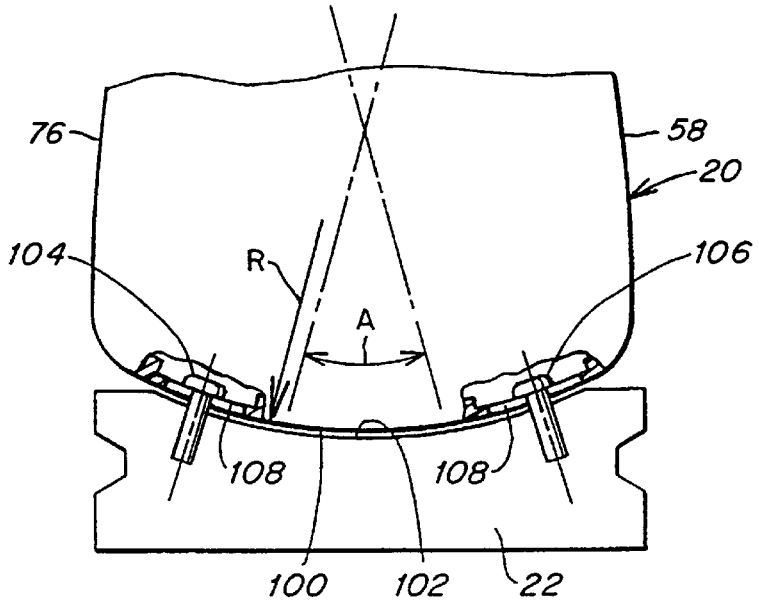
FIG. 11 is a schematic cross-sectional view taken along section line 3—3 of another embodiment for providing side-to-side flexibility in a snowboard boot.

In another embodiment of the invention shown in FIG. 11, side-to-side flexibility between the boot 20 and the binding interface 22 is provided using an arrangement that enables the boot 20 to slide side-to-side over the binding interface 22. The boot 20 and the binding interface 22 have arcuate surfaces 100, 102, respectively, that cooperate so that the boot may slide side-to-side across the binding interface through a desired angle A. The boot 20 and the binding interface 22 may be coupled to each other in any number of other ways that enable a sliding motion between the boot and the interface 22. In one embodiment, the interface 22 is slidably attached to the boot 20 with fastening members 104, 106 (e.g., screws, pins, rivets or the like) that are secured to the binding interface 22 and cooperate with slots 108 in the boot to enable the boot to slide with respect to the interface through an angle A defined by the length of the slot. Each fastening member 104, 106 cooperates with the ends of the slot 108 to act as a stop to limit the degree of side-to-side flexibility.

In the embodiment shown in FIG. 11, the boot 20 has a convex lower surface 100 and the binding interface 22 has a concave upper surface 102. Each surface has a radius R that allows smooth movement between the boot and the interface to provide the desired side-to-side flexibility. In one embodiment, the surfaces are smooth and have a cylindrical shape that extends along the entire length of the binding interface 22, the surfaces have a radius R of approximately 15 cm, and the slots 108 are provided in the boot 20 and have a side-to-side length of approximately 1 cm along the radius.

It should be understood that other arrangements are possible, such as a concave boot surface and a convex binding interface surface. Alternatively, the fastening members can be secured to the boot 20 and cooperate with slots in the binding interface 22. In addition, different lengths of the radii and slots may be used so long as the boot is capable of sliding across the binding interface through a desired angle. In the embodiment shown, the boot can flex inwardly and outwardly relative to the binding interface. However, it should be understood that the fastening members and/or the slots can be arranged to prevent the boot from flexing to the side in a particular direction (e.g., outwardly).

Figure 12:
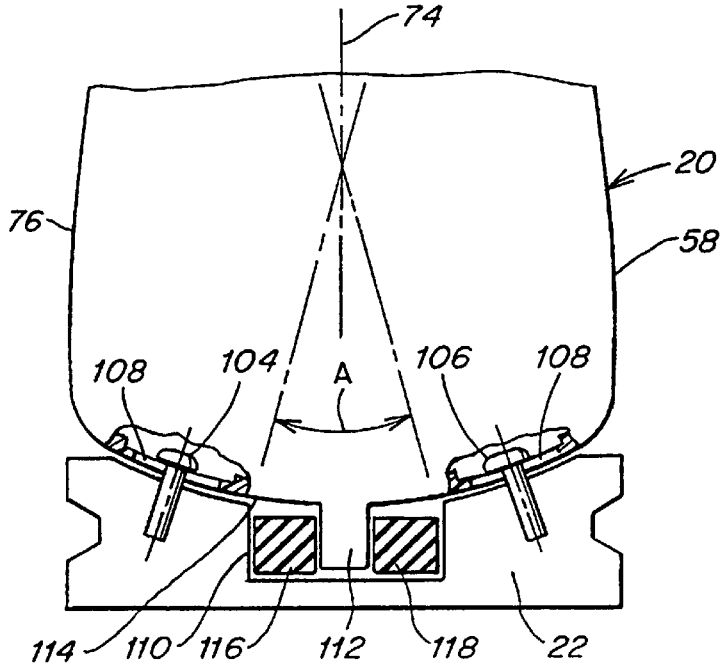
FIG. 12 is a schematic cross-sectional view taken along section line 3—3 of a further alternate embodiment for providing controlled side-to-side flexibility of a snowboard boot.

In one embodiment of the invention, the sliding arrangement of the present invention is provided with a dampening feature that produces a smooth sliding motion without abrupt stops as the boot is flexed to the extreme limits of its range. In an illustrative embodiment shown in FIG. 12, the binding interface 22 has a cavity 110 that is adapted to receive an arm or extension 112, such as a wall or rib, that is disposed on the bottom surface 114 of the boot 20. Dampening elements 116, 118 are disposed in the cavity 110 between each side of the arm 112 and a side of the cavity. As the boot 20 slides across the binding interface 22, one of the dampening members 116, 118 is compressed by the arm 112 and produces a variable opposing force on the arm that increases in proportion to the amount of flex to reduce the rate of sliding. The dampening element can also limit the side-to-side flex of the boot, such as when the dampening element becomes fully compressed by the arm. It should be understood that the arm 112 can be disposed on the binding interface 22 and the dampening elements 116, 118 can be disposed in the boot 20.

The dampening elements 116, 118 may be formed from a resilient element, such as rubber, compression springs, or the like. In one embodiment, the dampening elements 116, 118 are rubber and have a thickness of 1 cm, a width of 2 cm and a length that extends along the length of the binding interface. However, the sizes and the spring characteristics of the dampening elements may be varied to control the amount and direction of side-to-side flex. In addition, the arm 112 may be positioned on the boot in an off-center arrangement relative to the cavity 110 to reduce the amount of sliding and side-to-side flex to a particular side of the boot. For example, the arm 112 may be disposed closer to the inner side and away from the outer side of the cavity to reduce the outward lateral flex and increase the inner lateral flex of the boot. To achieve similar control, the cavity can be configured so that one side of the cavity is disposed closer to the arm than the opposite side of the cavity, or the dampening element on one side of the arm can have a size and/or spring characteristics that are different from those of the dampening element on the opposite side of the arm. Additionally, the arm and/or the cavity can be arranged to prevent the boot from flexing to the side in a particular direction (e.g., outwardly).

Figure 13:
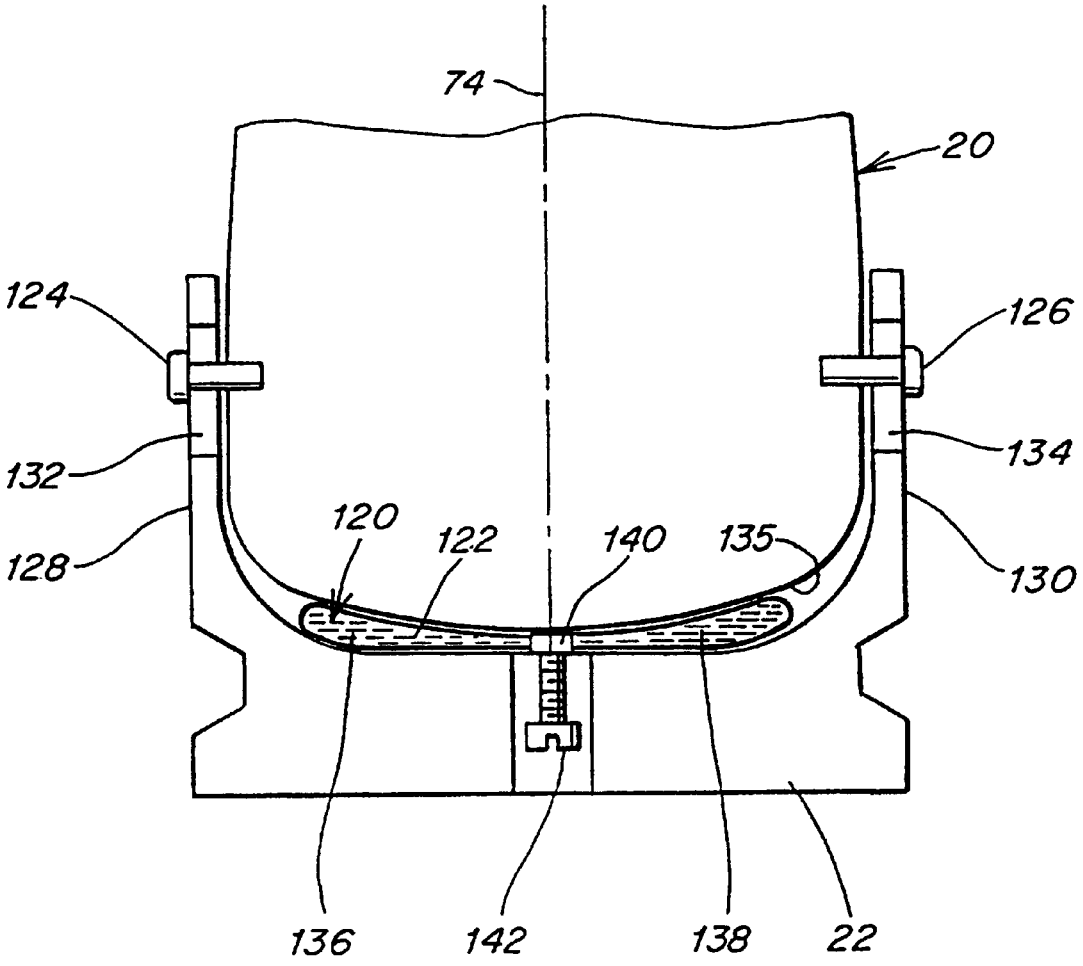
FIG. 13 is a schematic cross-sectional view similar to FIG. 9 of a further embodiment for providing controlled side-to-side flexibility of a snowboard boot.

Another illustrative embodiment for implementing side-to-side roll in a snowboard boot is illustrated in FIG. 13. In this embodiment, the binding interface 22 is slidably attached to the boot 20 using fasteners 124, 126 (e.g., rivets, pins, screws or the like) which extend through vertical connection members 128, 130 disposed on opposite sides of the binding interface 22. Each connection member 128, 130 is provided with a vertical slot 132, 134 so that the boot 20 may move and flex or roll to the side relative to the binding interface 22. Each fastener 124, 126 cooperates with the ends of the slot 132, 134 to act as a stop to limit the amount of movement between the binding interface and the boot. The lower surface 135 of the boot is arcuate (e.g., convex) to enhance the ability of the boot 20 to roll relative to the binding interface 22. It should be understood that the boot 20 and the binding interface 22 may be coupled to each other in any of a number of other ways that allows movement therebetween. For example, the boot may include the connection members with the binding interface being attached to the connecting members.

In an alternate embodiment for dampening the side-to-side flex or roll of the boot, the side-to-side flexibility of the boot 20 may be controlled using a dampening element disposed between the boot 20 and the binding interface 22. As illustrated in FIG. 13, the dampening element can be implemented using a fluid bladder 120, which includes a dampening fluid 122, disposed between the binding interface 22 and the boot 20. In the illustrative embodiment, the bladder 120 includes a pair of chambers 136, 138 that are positioned on opposite sides of the center plane 74 of the boot and are fluidly coupled through a valve 140. When the boot 20 moves relative to the binding interface 22, one chamber is squeezed so that its fluid 122 (e.g., a liquid or gas) is forced through the valve 140 and into the other chamber. The amount by which the side-to-side flexibility or roll of the boot 20 relative to the binding interface 22 is dampened is a function of the rate and amount of fluid transfer between the chambers. Consequently, the amount of dampening can be controlled by adjusting the rate that the fluid 22 is transferred between the chambers 136, 138. An adjustment screw 142 may be used to adjust the size of the valve opening between the chambers.

It should be understood that the binding interface of the present invention may be configured to interface with various step-in or side-grip binding arrangements, and is not limited to the particular binding arrangement discussed above. For example, the binding interface 22 may include outwardly extending bail or plate members, longitudinal rods, or other interface features capable of securing a boot to a binding. The snowboard boot system can be provided with a set of interchangeable binding interfaces that include various interface features to allow the suspension system of the present invention to be used with different snowboard binding arrangements.

Having described several embodiments of the invention in detail, various modifications and improvements will readily occur to those skilled in the art. Such modifications and improvements are intended to be within the spirit and scope of the invention. Accordingly, the foregoing description is by way of example only and is not intended as limiting. The invention is limited only as defined by the following claims and the equivalents thereto.

What is claimed is:

1. An apparatus comprising:

a snowboard boot including a bottom portion and at least one pair of attachment points disposed on the bottom portion that are spaced apart in a side-to-side direction;

a binding interface that is movably mounted to the bottom portion of the snowboard boot so that the bottom portion of the snowboard boot can flex, relative to the binding interface, in the side-to-side direction through an angle when the binding interface is engaged by a snowboard binding, the binding interface including at least one interface feature adapted to engage with the snowboard binding; and at least one pair of strapless fasteners that mount the binding interface to the bottom portion of the snowboad boot at the at least one pair of attachment points.

2. The apparatus recited in claim 1, wherein the at least one interface feature includes a first interface feature disposed adjacent a first side of the boot and a second interface feature disposed adjacent a second side of the boot.

3. The apparatus recited in claim 2, wherein at least one of the first and second interface features has at least one recess that is adapted to receive a portion of the snowboard binding therein.

4. The apparatus recited in claim 1, wherein the pair of attachment points includes a first attachment point and a second attachment point, and wherein the snowboard boot is constructed and arranged to flex in the side-to-side direction along a first portion of the boot, the first portion extending between a first side of the boot and the first attachment point.

5. The apparatus recited in claim 4, wherein the first portion is adapted to lift away from the binding interface when the boot is flexed in the side-to-side direction.

6. The apparatus recited in claim 1, wherein the boot includes a sole that is selectively stiffened to resist heel lift while enabling flex in the side-to-side direction.

7. The apparatus recited in claim 1, wherein the at least one pair of attachment points includes a first attachment point and a second attachment point, the first attachment point being spaced a first distance from a first side of the boot and the second attachment point being spaced a second distance from a second side of the boot, the first distance being greater than the second distance so that the boot may be flexed in the side-to-side direction by a greater amount toward the second side than toward the first side.

8. The apparatus recited in claim 7, wherein the second attachment point is disposed substantially at the second side to limit side-to-side flexibility between the boot and the binding interface in the side-to-side direction toward the first side.

9. The apparatus recited in claim 1, wherein the at least one pair of attachment points includes a first attachment point and a second attachment point, the first attachment point being spaced a first distance from a first side of the boot and the second attachment point being spaced a second distance from a second side of the boot, at least one of the first and second distances being selectable to adjust the side-to-side flexibility of the boot.

10. The apparatus recited in claim 1, further comprising a resilient element disposed between the boot and the binding interface.

11. The apparatus recited in claim 10, wherein the at least one resilient element extends to at least one of a first side of the boot and a second side of the boot.

12. The apparatus recited in claim 1, further comprising at least one flexible attachment member that cooperates with at least one of the strapless fasteners to movably mount the binding interface to the boot.

13. The apparatus recited in claim 12, wherein the at least one flexible attachment member includes a flexible mounting boss disposed on one of the boot and the binding interface.

14. The apparatus recited in claim 12, wherein the at least one flexible attachment member includes a compressible member disposed between the at least one of the pair of strapless fasteners and the binding interface.

15. The apparatus recited in claim 1, further comprising a stop, coupled to one of the boot and the binding interface, that is constructed and arranged to limit the side-to-side flexibility of the boot.

16. The apparatus recited in claim 1, further comprising a lock, coupled to one of the boot and the binding interface, that is constructed and arranged to selectively lock the boot at a flex angle relative to the binding interface.

17. The apparatus recited in claim 1, wherein the binding interface is slidably mounted to the boot.

18. The apparatus recited in claim 1, further comprising:

a fluid-filled bladder disposed between the boot and the binding interface.

19. The apparatus recited in claim 1, further comprising a dampening element, coupled to the snowboard boot and the binding interface, that is constructed and arranged to dampen the side-to-side flexibility between the boot and the binding interface.

20. The apparatus recited in claim 1, further comprising means for restricting the side-to-side flexibility between the snowboard boot and the binding interface.

21. The apparatus recited in claim 20, further comprising means for dampening the side-to-side flexibility between the snowboard boot and the binding interface.

22. The apparatus recited in claim 1, further comprising means for dampening the side-to-side flexibility between the snowboard boot and the binding interface.

23. An apparatus comprising:

a snowboard boot including a bottom portion and a bottom surface; and a strapless binding interface that is movably mounted to the bottom portion of the snowboard boot so that the bottom portion of the snowboard boot can flex side-to-side relative to the binding interface to provide side-to-side flexibility when the binding interface is engaged by a snowboard binding, the binding interface including a first interface feature disposed adjacent a first side of the boot and a second interface feature disposed adjacent a second side of the boot, the first and second interface features being adapted to engage with the snowboard binding, wherein at least a portion of at least one of the first and second interface features does not protrude below the bottom surface of the boot.

24. The apparatus recited in claim 23, wherein at least one of the first and second interface features has at least one recess that is adapted to receive a portion of the snowboard binding therein.

25. The apparatus recited in claim 23, further comprising at least one resilient element coupled to one of the boot and the binding interface.

26. The apparatus recited in claim 25, wherein the resilient element is disposed between the boot and the binding interface.

27. The apparatus recited in claim 26, wherein the resilient element extends to at least one of the first side of the boot and the second side of the boot.

28. The apparatus recited in claim 23, further comprising a stop, coupled to one of the boot and the binding interface, that is constructed and arranged to limit the side-to-side flexibility of the boot.

29. The apparatus recited in claim 23, further comprising a lock, coupled to one of the boot and the binding interface, that is constructed and arranged to selectively lock the boot at a flex angle relative to the binding interface.

30. The apparatus recited in claim 23, wherein the binding interface is slidably mounted to the boot.

31. The apparatus recited in claim 23, further comprising:

a fluid-filled bladder disposed between the boot and the binding interface.

32. The apparatus recited in claim 23, further comprising a dampening element, coupled to the snowboard boot and the binding interface, that is constructed and arranged to dampen the side-to-side flexibility between the boot and the binding interface.

33. The apparatus recited in claim 23, further comprising means for restricting the side-to-side flexibility between the snowboard boot and the binding interface.

34. The apparatus recited in claim 33, further comprising means for dampening the side-to-side flexibility between the snowboard boot and the binding interface.

35. The apparatus recited in claim 23, further comprising means for dampening the side-to-side flexibility between the snowboard boot and the binding interface.

36. An apparatus comprising:

a snowboard boot including a bottom portion, a first side and a second side; and a strapless binding interface movably mounted to the bottom portion of the snowboard boot so that the bottom portion of the snowboard boot can flex side-to-side relative to the binding interface to provide side-to-side flexibility when the binding interface is engaged by a snowboard binding, the binding interface including at least one interface feature adapted to engage with the snowboard binding, wherein the at least one interface feature does not protrude beyond the first and second sides of the boot.

37. The apparatus recited in claim 36, wherein the at least one interface feature includes a first interface feature disposed adjacent a first side of the boot and a second interface feature disposed adjacent a second side of the boot.

38. The apparatus recited in claim 37, wherein at least one of the first and second interface features has at least one recess that is adapted to receive a portion of the snowboard binding therein.

39. The apparatus recited in claim 38, wherein the at least one recess is tapered.

40. The apparatus recited in claim 37, wherein at least one of the first and second interface features includes a pair of recesses with a non-recessed portion therebetween.

41. The apparatus recited in claim 36, further comprising a stop, coupled to one of the boot and the binding interface, that is constructed and arranged to limit the side-to-side flexibility of the boot.

42. The apparatus recited in claim 36, further comprising a lock, coupled to one of the boot and the binding interface, that is constructed and arranged to selectively lock the boot at a flex angle relative to the binding interface.

43. The apparatus recited in claim 36, wherein the binding interface is slidably mounted to the boot.

44. The apparatus recited in claim 36, further comprising:

a fluid-filled bladder disposed between the boot and the binding interface.

45. The apparatus recited in claim 36, further comprising a dampening element, coupled to the snowboard boot and the binding interface, that is constructed and arranged to dampen the side-to-side flexibility between the boot and the binding interface.

46. The apparatus recited in claim 36, further comprising means for restricting the side-to-side flexibility between the snowboard boot and the binding interface.

47. The apparatus recited in claim 46, further comprising means for dampening the side-to-side flexibility between the snowboard boot and the binding interface.

48. The apparatus recited in claim 36, further comprising means for dampening the side-to-side flexibility between the snowboard boot and the binding interface.

49. An apparatus comprising:

a snowboard boot including a bottom portion;

a binding interface that is movably mounted to the bottom portion of the snowboard boot so that the bottom portion of the snowboard boot can flex side-to-side relative to the binding interface to provide side-to-side flexibility when the binding interface is engaged by a snowboard binding, the binding interface including at least one interface feature adapted to engage with the snowboard binding; and an adjustment member, supported by one of the boot and the binding interface, that is constructed and arranged to adjustably restrict the side-to-side flexibility between the bottom portion of the boot and the binding interface.

50. The apparatus recited in claim 49, wherein the adjustment member includes at least one fastener that mounts the binding interface to the boot at a selectable attachment point.

51. The apparatus recited in claim 49, further comprising a locking member that is adapted to engage the adjustment member to restrict the side-to-side flexibility.

52. The apparatus recited in claim 51, wherein the locking member is movable between a first position to lock the boot at a flex angle and a second position to release the boot so that the boot is not locked at the flex angle.

53. The apparatus recited in claim 51, wherein the adjustment member has a slot that is adapted to receive a portion of the locking member therein.

54. The apparatus recited in claim 51, wherein the adjustment member includes a threaded shaft, the locking member threadedly engaging the shaft.

55. The apparatus recited in claim 49, wherein the boot includes an inner side and an outer side, the adjustment system being disposed adjacent at least one of the inner side and the outer side.

56. The apparatus recited in claim 49, further comprising means for dampening the side-to-side flexibility between the snowboard boot and the binding interface.

57. An apparatus comprising:

a snowboard boot including a bottom portion;

a binding interface that is movably mounted to the bottom portion of the snowboard boot so that the bottom portion of the snowboard boot can flex side-to-side relative to the binding interface to provide side-to-side flexibility when the binding interace is engaged by a snowboard binding, the binding interface including at least one interface feature adapted to engage with the snowboard binding; and a dampening element, coupled to at least one of the boot and the binding interface, that is constructed and arranged to dampen the side-to-side flexibility between the bottom portion of the boot the binding interface.

58. The apparatus recited in claim 57, wherein the dampening element is constructed and arranged to produce a variable force in proportion to the degree of side-to-side flex between the boot and the binding interface.

59. The apparatus recited in claim 58, further comprising an arm, supported by one of the boot and the binding interface, that is constructed and arranged to cooperate with the dampening element to dampen the side-to-side flexibility between the boot and the binding interface.

60. The apparatus recited in claim 58, wherein the dampening element includes a spring.

61. The apparatus recited in claim 57, wherein the dampening element is adjustable to vary the degree of dampening between the boot and the binding interface.

62. The apparatus recited in claim 57, wherein the dampening element is disposed between the boot and the binding interface.

63. The apparatus recited in claim 62, wherein the dampening element extends to at least one of a first side of the boot and a second side of the boot.

64. The apparatus recited in claim 57, wherein the dampening element includes a fluid-filled bladder disposed between the boot and the binding interface.

65. The apparatus recited in claim 64, wherein the bladder includes a first chamber and a second chamber, the first chamber being fluidly coupled to the second chamber so that fluid can be exchanged between the first and second chambers when the boot is flexed in the side-to-side direction.

66. The apparatus recited in claim 65, wherein the bladder further includes a valve to vary the rate of fluid exchange between the first and second chambers.

67. The apparatus recited in claim 57, further comprising means for adjusting the maximum side-to-side flexibility allowed between the snowboard boot and the binding interface.

68. The apparatus recited in claim 57, further comprising means for limiting the side-to-side flexibility between the snowboard boot and the binding interface.

69. The apparatus recited in claim 57, further comprising means for fixing the snowboard boot at a selected flex angle relative to the binding interface.

70. An apparatus comprising:

a snowboard boot including a sole and at least one attachment point; and a binding interface that is mounted to the snowboard boot at the at least one attachment point, the binding interface including at least one interface feature adapted to engage with a snowboard binding;

wherein a portion of the sole of the snowboard boot disposed between the at least one attachment point and a first side of the boot is flexible, so that the snowboard boot can flex side-to-side relative to the binding interface.

71. The apparatus recited in claim 70, wherein the portion of the sole of the boot is adapted to lift away from the binding interface when the boot is flexed side-to-side.

72. The apparatus recited in claims 70, wherein the sole is selectively stiffened to resist heel lift while enabling side-to-side flex.

73. The apparatus recited in claim 70, further comprising at least one resilient element disposed between the boot and the binding interface.

74. The apparatus recited in claim 73, wherein the resilient element is disposed adjacent a second side of the boot.

75. The apparatus recited in claim 70, further comprising a stop, coupled to one of the boot and the binding interface, that is constructed and arranged to limit the amount of side-to-side flex between the boot and the binding interface.

76. The apparatus recited in claim 70, further comprising a lock, coupled to one of the boot and the binding interface, that is constructed and arranged to selectively lock the boot at a flex angle relative to the binding interface.

77. The apparatus recited in claim 70, further comprising a dampening element, coupled to the snowboard boot and the binding interface, that is constructed and arranged to dampen the side-to-side flexibility between the boot and the binding interface.

78. The apparatus recited in claim 70, further comprising means for restricting an amount of side-to-side flex between the snowboard boot and the binding interface.

79. The apparatus recited in claim 70, further comprising means for dampening side-to-side flex between the snowboard boot and the binding interface.

* * * * *